US006571394B1

(12) United States Patent
Hackett et al.

(10) Patent No.: US 6,571,394 B1
(45) Date of Patent: Jun. 3, 2003

(54) BALL GLOVE WITH CONCAVE WEBBING

(75) Inventors: James Hackett, Chicago, IL (US); Shiegeaki Aso, Arlington Heights, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/570,068

(22) Filed: May 12, 2000

(51) Int. Cl.[7] ..... A41D 13/08
(52) U.S. Cl. ..... 2/19
(58) Field of Search ..... 2/16, 19, 20, 159, 2/161.1, 167, 169; 473/205, 458

(56) References Cited

U.S. PATENT DOCUMENTS 3,042,929 A * 7/1962 Kobos ..... 2/19
3,590,389 A * 7/1971 Latina ..... 2/19
3,721,996 A * 3/1973 Nadorf ..... 2/19
5,379,460 A * 1/1995 Aoki ..... 2/19
D367,950 S * 3/1996 Sewell ..... D29/115
5,678,245 A * 10/1997 Rector et al. ..... 2/19
5,706,519 A * 1/1998 Cooper ..... 2/16
6,182,289 B1 * 2/2001 Brown ..... 2/19

* cited by examiner

*Primary Examiner*—Gary L Welch

(57) ABSTRACT

A ball glove includes a concave webbing which forms a ball-receiving pocket. The webbing is secured to spaced-apart finger and thumb sections of the glove and is formed from a plurality of flat panels. The combined area of the flat panels is greater than the area of the space between the finger and thumb sections. The panels have curved side edges which are secured together so that the panels assume a concave configuration before the panels are secured to the finger and thumb sections.

18 Claims, 5 Drawing Sheets

BALL GLOVE WITH CONCAVE WEBBING

BACKGROUND AND SUMMARY OF THE INVENTION

This invention relates to ball gloves such as baseball gloves and softball gloves. More particularly, the invention relates to a ball glove with a concave webbing which facilitates catching a ball.

Typical youth gloves have a catching pocket which is too small. Young players have a difficult time catching a standard size youth baseball or softball.

The invention provides a ball glove with a concave pocket which creates a large pocket which has a shape similar to the spherical shape of a standard size youth ball. The webbing is formed from a plurality of flat panels, and the combined width and the length of the panels is greater than the width and length of the space between the thumb and first finger of the glove. When the webbing is attached to the thumb and finger, the webbing forms a concave pocket for the ball.

DESCRIPTION OF THE DRAWING

The invention will be explained in conjunction with the accompanying drawing, in which.

DESCRIPTION OF THE SPECIFIC EMBODIMENT

Figure 1:
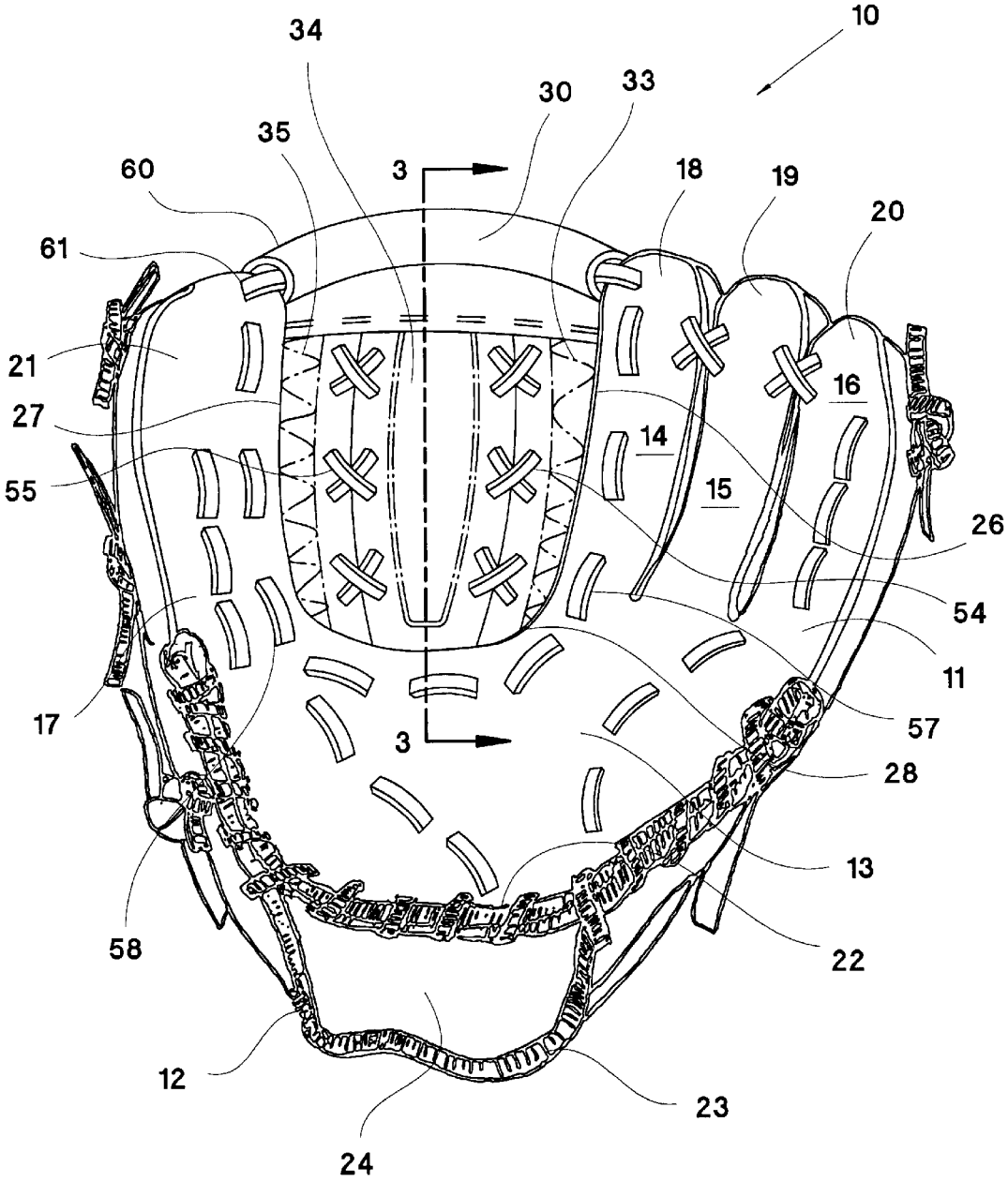
FIG. 1 is a front perspective view of a ball glove which is formed in accordance with the invention.

Referring to FIGS. 1–4, a ball glove 10 includes front and rear plies or panels 11 and 12 which are secured together to form the front and back of the glove. The front panel 11 includes a palm portion 13 and upwardly extending finger portions 14, 15, and 16 and a thumb portion 17. The back panel includes similarly shaped finger and thumb portions, and the finger and thumb portions form finger and thumb stalls 18, 19, 20, and 21 when the front and back panels 11 and 12 are secured together. The front and back include bottom edges 22 and 23, and portions of the bottom edges are left unsecured to provide a hand opening 24.

The ball glove which has been described to this point may be conventional, and the front and back panels are secured together in the conventional manner. The glove illustrated in the drawing is a youth size glove which is intended to be worn by young players. The glove can be designed for use with standard size youth baseballs, standard size youth softballs, regulation size baseballs or softballs, or other sizes of balls.

Adult ball players commonly catch the ball in the pocket which is formed in the palm portion of the glove. However, young players have difficulty catching a ball in the palm portion of the glove. Young players often find it easier to catch the ball in the webbing which extends between the thumb stall and the first finger stall.

In most gloves, the area of the webbing is substantially the same as the area of the space between the thumb and the first finger. The webbing is somewhat flat and does not form a natural pocket for catching the ball.

The thumb stall 21 and the finger stall 18 form a web receiving opening. As viewed in FIG. 1, the right side 26 of the opening is formed by the finger stall 18, the left side 27 of the opening is formed by the thumb stall 21, and the curved bottom 28 of the opening is formed by the palm portion 13 of the front panel 11 and the corresponding portion of the back panel 12. A webbing 30 is secured to the sides and bottom of the web opening.

Figure 3:
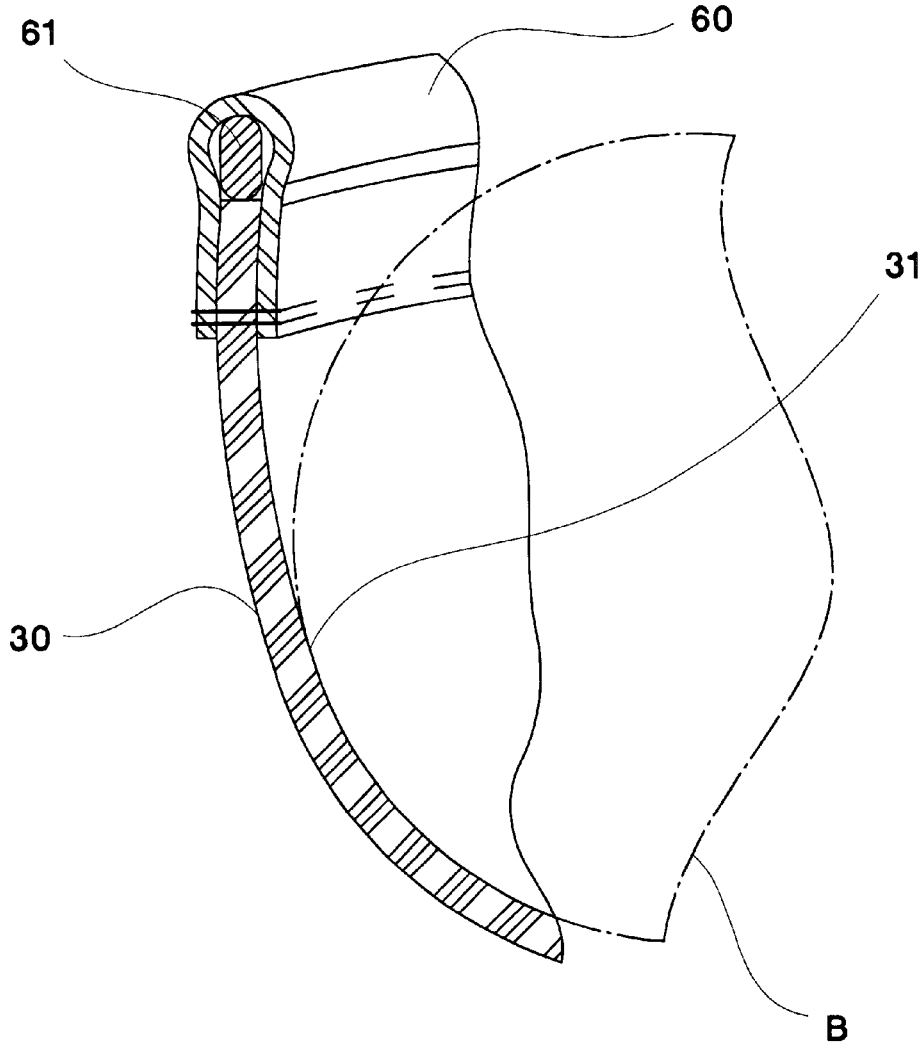
FIG. 3 is a fragmentary sectional view taken along the line 3—3 of FIG. 1.
Figure 4:
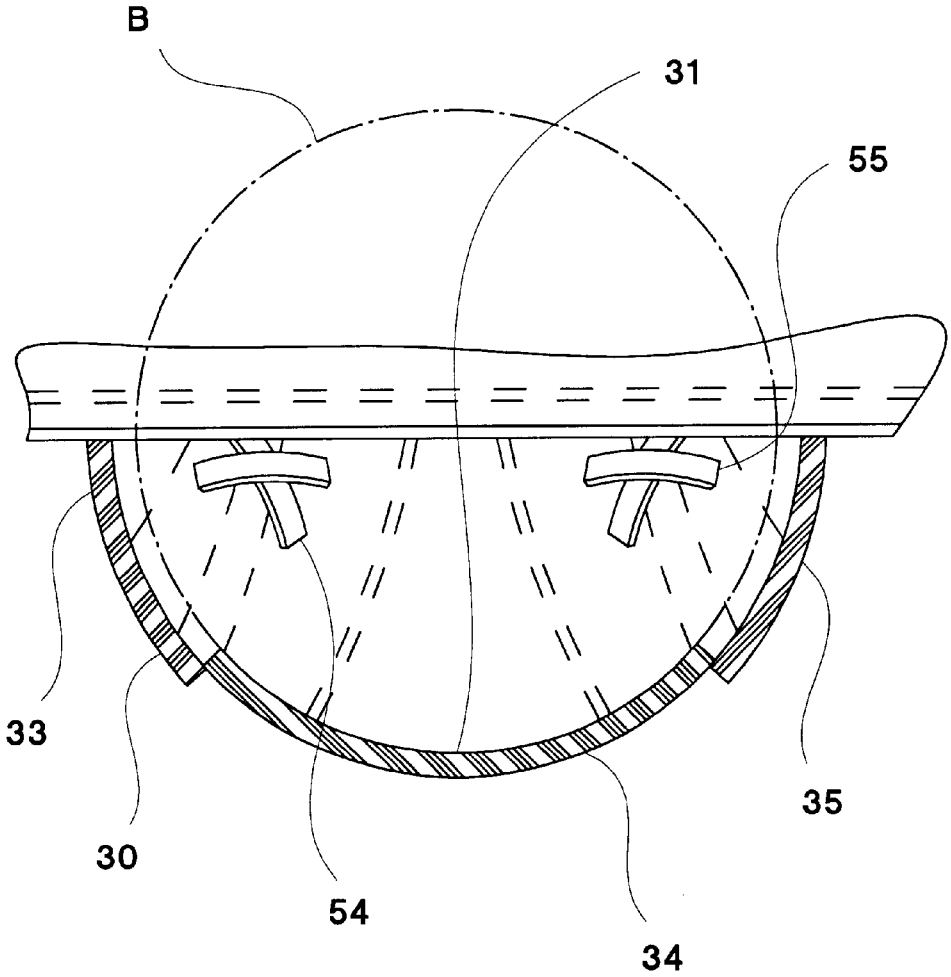
FIG. 4 is a fragmentary sectional view taken along the line 4—4 of FIG. 2.

As can be seen in FIGS. 3 and 4, the webbing 30 forms a concave pocket 31. The pocket 31 has substantially the shape of a portion of a sphere, and the spherical shape of the pocket facilitates catching a ball B in the webbing.

Figure 5:
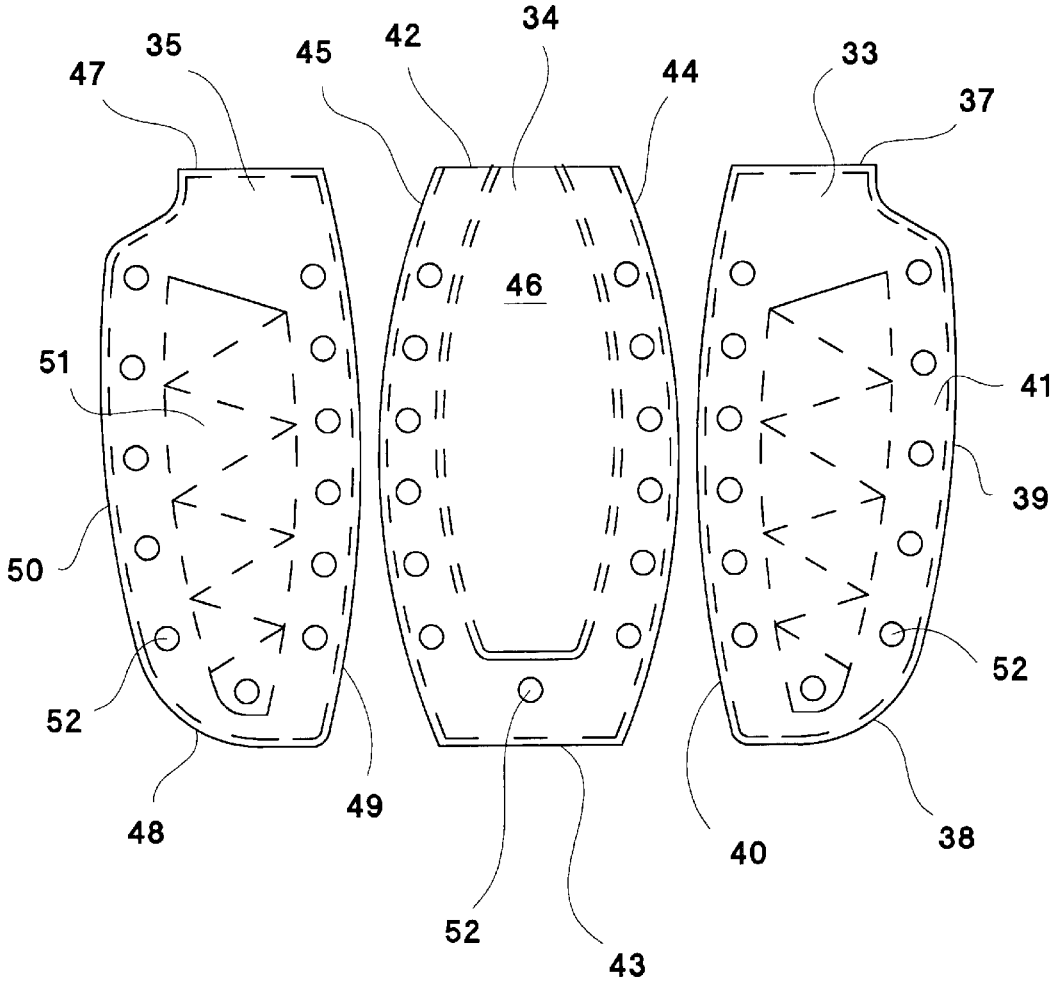
FIG. 5 is a plan view of the flat panels which form the webbing of the glove.

Referring to FIG. 5, the webbing is formed from three flat panels 33, 34, and 35. The panel 33 is adapted to be secured to the first finger stall 18, and the panel 35 is adapted to be secured to the thumb stall 21. The middle panel 34 is adapted to be attached to the curved bottom 28 of the web opening.

The right or finger panel 33 includes top and bottom edges 37 and 38, an outer side edge 39, and a curved inner side edge 40. The midportion 41 of the panel is wider than the end portions.

The middle panel 34 includes top and bottom edges 42 and 43 and curved side edges 44 and 45. The midportion 46 of the panel is wider than the end portions.

The left or thumb panel 35 includes top and bottom edges 47 and 48, curved inner side edge 49, and outer side edge 50. The midportion 51 of the panel is wider than the end portions.

Each of the panels is provided with lace openings 52 for securing the panels together and to the glove.

The length or height of each of the flat panels 33–35 between the top and bottom edges thereof is greater than the length or height of the portion of the web opening where those panels will be positioned. The height of the web opening is defined by the dimensions of the finger stall and the thumb stall 21 which extend beyond the bottom 28 of the opening. Similarly, the combined width of the three panels is greater than the width of the web opening betwen the stalls 18 and 21. The total area of the three flat panels is greater than the area of the web opening. The three panels will thus assume a concave shape when they are attached to the edge of the web opening.

Figure 2:
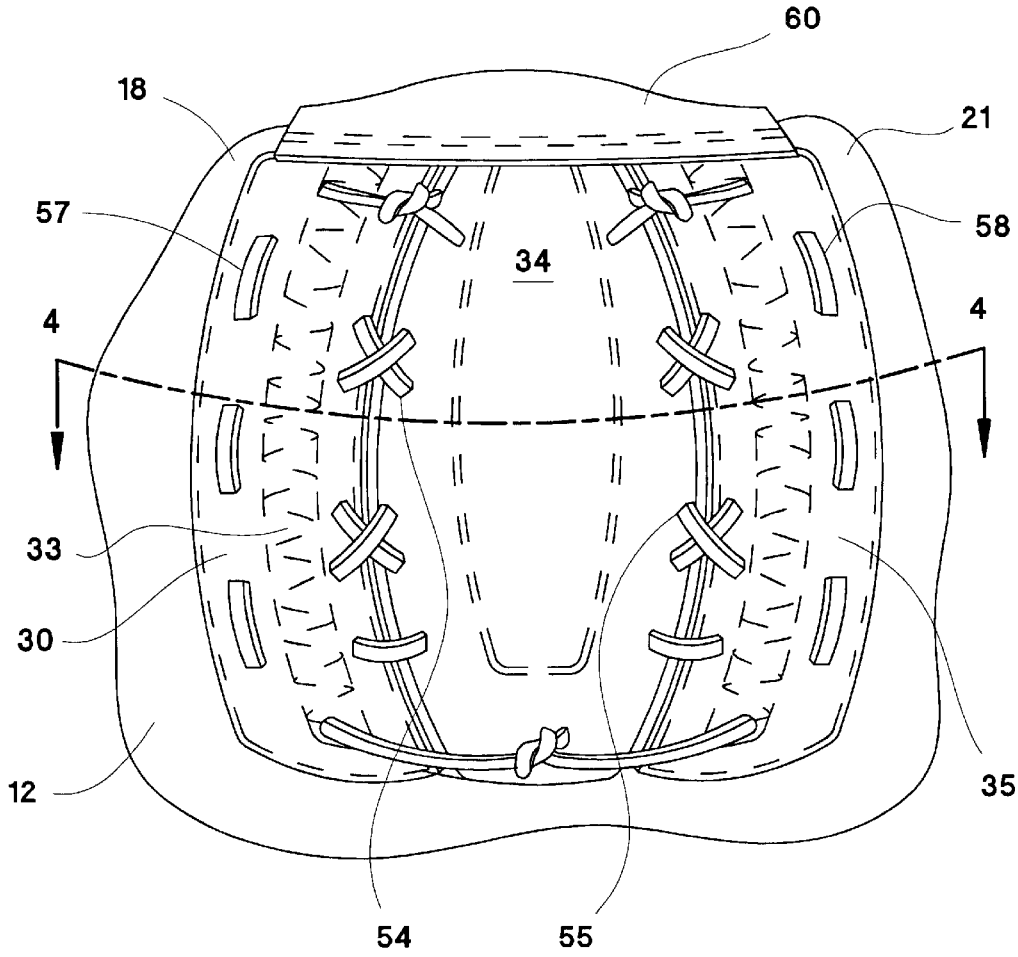
FIG. 2 is a fragmentary rear perspective view of the glove.

The left curved edge 40 of the panel 33 is secured to the right curved edge 44 of the middle panel 34 by lace 54 (FIGS. 1, 2, and 4). The right curved edge 49 of the left panel 35 is secured to the left curved edge 45 of the middle panel 34 by lace 55. Because the secured edges 40 and 44 and the secured edges 45 and 49 curve in opposite directions, the secured panels will be forced into a concave shape before the panels are secured to the glove.

After the panels are secured together, the edge 39 of the panel 33 is secured to the finger stall 18 by lace 57 (FIGS. 1 and 2) and the edge 50 of the panel 35 is secured to the thumb stall 21 by lace 58. The shape of each of the edges 39 and 50 is slightly curved to conform to the shape of the stalls 18 and 21.

The webbing includes a top piece 60 which is folded over the top edges of the panels 33–35 and secured by stitching. The top piece forms a channel through which a top lace 61 extends to reinforce the top of the webbing.

The webbing 30 permits a bigger, deeper pocket 31 than conventional webbings. The bigger, deeper pocket makes it easier for a young player to catch and hold a ball. After the ball is caught in the pocket, the player can exert a slight closing force with his hand to bring the finger stall 18 and thumb stall 21 toward each other to retain the ball in the pocket. The deep pocket can be closed easier than the pocket of a conventional webbing.

While in the foregoing specification a detailed description of specific embodiments of the invention was set forth for the purpose of illustration, it will be understood that many of the details hereingiven can be varied considerably by those skilled in the art without departing from the spirit and scope of the invention.

We claim:

1. A ball glove comprising:

a glove body having a lower palm portion and spaced-apart finger and thumb sections which extend upwardly from the palm portion to form a spacing between the finger and thumb sections, and an un-pleated webbing attached to the finger and thumb sections, the webbing including first, second and third regions, the first region positioned between the second and third regions, the second region positioned adjacent to the finger section, the third region positioned adjacent the thumb section, the first region having a first midportion positioned between a first upper end portion and a first lower end portion, the width of the first region being greatest at the first midportion, the total area of the webbing being greater than the area of the spacing, such that the webbing forms a deep, generally concave pocket at the spacing.

2. The glove of claim 1 in which the generally concave pocket has substantially the shape of a portion of a sphere.

3. The glove of claim 1 wherein each of the first, second and third regions of the webbing includes at least one panel.

4. The glove of claim 1 wherein second region includes a second upper end portion, a second lower end portion, and a second midportion, the second midportion being wider than each of the second upper and lower end portions.

5. The glove of claim 4 wherein third region includes a third upper end portion, a third lower end portion, and a third midportion, the third midportion being wider than each of the third upper and lower end portions.

6. The glove of claim 5 further comprising a reinforcing top piece coupled to at least one of the first, second and third upper end portions of the first, second and third regions, respectively.

7. The glove of claim 1 wherein the first region is attached to the second and third regions.

8. The glove of claim 7 wherein the first region is attached to the second and third regions by at least one lace.

9. The glove of claim 1 wherein the spacing has a height dimension defined by the upward extension of the finger and thumb sections from the palm portion, and the height of the webbing, prior to attachment to the glove body, is greater than the height dimension of the spacing.

10. The glove of claim 1 wherein the spacing has a width dimension defined by the distance between the finger and thumb sections, and the width of the webbing, prior to attachment to the glove body, is greater than the width dimension of the spacing.

11. The glove of claim 1 further comprising a reinforcing top piece coupled to the first upper end portion of the first region of the webbing.

12. A method of forming a ball glove with an enlarged, deep, concave pocket for facilitating the catching and holding of a ball, the method comprising the steps of:

forming a glove body having a lower palm portion and spaced-apart finger and thumb sections which extend upwardly from the palm portion to define a spacing between the finger and thumb sections;

forming an un-pleated webbing by, obtaining first, second and third regions of a webbing, the first region having a first midportion positioned between a first upper end portion and a first lower end portion, the width of the first region being greatest at the first midportion, and attaching the first region to the second and third regions, the first, second and third regions having a total area that is greater than the area of the spacing; and connecting the webbing to the glove body by attaching the second region to the finger section and the third region to the thumb section, the connection providing the enlarged, deep, generally concave pocket in the webbing.

13. The method of claim 12, wherein the first region is attached to the second and third regions with at least one lace.

14. The method of claim 12, wherein the second region is attached to the finger section with at least one lace.

15. The method of claim 14, wherein the third region is attached to the thumb section with the at least one lace.

16. The method of claim 12 further comprising the steps of:

obtaining a reinforcing top piece, and coupling the top piece to at least one of the first, second and third regions.

17. The method of claim 12 wherein in the generally concave pocket has substantially the shape of a portion of a sphere.

18. The method of claim 12 wherein each of the first, second and third regions of the webbing includes at least one panel.

* * * * *